US006938535B2

(12) United States Patent
Price

(10) Patent No.: US 6,938,535 B2
(45) Date of Patent: Sep. 6, 2005

(54) HYDRAULIC ACTUATOR CONTROL

(75) Inventor: Robert Jean Price, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 87 days.

(21) Appl. No.: 10/318,289

(22) Filed: Dec. 13, 2002

(65) Prior Publication Data

US 2004/0112207 A1 Jun. 17, 2004

(51) Int. Cl.[7] ..... F15B 13/16
(52) U.S. Cl. ..... 91/361; 91/363 R
(58) Field of Search ..... 91/361, 363 R, 91/435, 364, 433

(56) References Cited

U.S. PATENT DOCUMENTS

| | | | | |
|---|---|---|---|---|
| 4,358,989 A | | 11/1982 | Tordenmalm | |
| 4,773,302 A | * | 9/1988 | Mizota et al. | 91/361 |
| 5,189,940 A | * | 3/1993 | Hosseini et al. | 91/361 |
| 5,218,895 A | | 6/1993 | Lukich et al. | |
| 5,305,681 A | | 4/1994 | Devier et al. | |
| 5,305,689 A | | 4/1994 | Schiel | |
| 5,537,818 A | | 7/1996 | Hosseini et al. | |
| 5,560,387 A | | 10/1996 | Devier et al. | |
| 5,701,793 A | * | 12/1997 | Gardner et al. | 91/361 |
| 5,727,387 A | | 3/1998 | Hosseini et al. | |
| 5,784,945 A | | 7/1998 | Krone et al. | |
| 5,899,008 A | | 5/1999 | Cobo et al. | |
| H1846 H | | 4/2000 | Poorman | |
| 6,233,511 B1 | | 5/2001 | Berger et al. | |
| 6,257,118 B1 | | 7/2001 | Wilbur et al. | |
| 6,305,419 B1 | | 10/2001 | Krieger et al. | |
| 6,389,952 B1 | | 5/2002 | Riddick et al. | |
| 6,546,724 B2 | | 4/2003 | Nishimura et al. | |
| 6,609,369 B2 | * | 8/2003 | Koehler et al. | 91/363 R |

FOREIGN PATENT DOCUMENTS

| | | |
|---|---|---|
| GB | 1518720 | 7/1978 |
| GB | 2281638 A | 3/1995 |
| JP | 09-041421 A | 2/1997 |
| JP | 10-159135 A | 6/1998 |
| JP | 11-181840 A | 7/1999 |

* cited by examiner

*Primary Examiner*—Edward K. Look
*Assistant Examiner*—Igor Kershteyn
(74) *Attorney, Agent, or Firm*—Finnegan, Henderson, Farabow, Garrett & Dunner

(57) ABSTRACT

A method is provided for controlling hydraulic flow to a hydraulic actuator. The method includes generating a command signal based on an operator input, sensing a linkage position associated with the hydraulic actuator, and selecting a moving rate of a valve associated with the hydraulic actuator based on the sensed linkage position and the command signal. The valve is modulated to control the hydraulic flow to the hydraulic actuator based on the selected moving rate.

20 Claims, 2 Drawing Sheets

HYDRAULIC ACTUATOR CONTROL

TECHNICAL FIELD

This invention relates to a method and system for controlling hydraulic actuators. More particularly, the invention is directed to a method and system for controlling hydraulic flow to an actuator in fluid communication with a pump.

BACKGROUND

The hydraulic circuit of a work machine, such as an excavator or a loader, typically includes a pump, a valve, and a hydraulic actuator in fluid communication. The hydraulic actuator may be a hydraulic cylinder, a hydraulic motor, or another hydraulic device supplying motive power to a work implement or drive train of the machine. When an operator of the machine actuates a valve by, for example, manually moving a lever, pressurized hydraulic fluid flows from the pump to the hydraulic actuator through the valve to move a work element of the hydraulic actuator, such as a piston in a hydraulic cylinder. This movement of the work element results in movement of an implement or a linkage assembly, such as a bucket, a boom, or a stick, coupled to the work element. For example, when a boom is to be raised, the operator moves the lever associated with the hydraulic circuit for the boom to open or close a valve in the circuit and to thereby pressurize an appropriate chamber of the hydraulic actuator in the circuit. Generally, in a work machine, there are multiple hydraulic circuits to control each of the work implements and linkage assemblies independently. Typically, each hydraulic circuit includes a valve and a hydraulic actuator.

In normal operation, the implement or linkage assembly is often brought to an abrupt stop after performing a given function. For example, a boom of a loader being lowered toward the ground may come to an abrupt stop when it hits the ground. Similarly, the boom may be raised to the upper end of its range of motion and come to an abrupt stop. When an implement or linkage assembly comes to an abrupt stop, significant forces are absorbed by the machine, resulting in an increased machine failure and maintenance. Also, such an abrupt stop causes a jerky movement of the machine and discomfort to the machine operator. A similar condition may occur when a moving speed of an implement or linkage assembly is significantly accelerated or decelerated.

To solve these problems, some hydraulic systems control stopping of the hydraulic cylinder at the end of stroke by hydraulic snubbers enclosed within the cylinder. Also, some systems provide a "snubbing" or "feather catch" operation to electronically modulate the lowering speed of an implement during gravity assisted operations. U.S. Pat. No. 5,727,387, for example, discloses an implement control apparatus for a work machine. The apparatus includes multiple hydraulic cylinders in fluid communication with a pump and valves. The apparatus senses a joystick position and generates an electrical valve signal proportional to ajoystick position signal. While the apparatus disclosed in U.S. Pat. No. 5,727,387 controls hydraulic fluid flow through a valve based on a joystick position signal, it does not control hydraulic actuators for a work machine by sensing a linkage position and a command signal and selecting a moving rate of the actuators.

Also, U.S. Pat. No. 6,257,118 discloses an apparatus for controlling a hydraulic cylinder. The apparatus includes an electronic controller that receives an operator command signal and a position signal, determines a velocity of an element, and determines a limit value in response to the velocity of the element. The apparatus, however, does not control hydraulic flow to a hydraulic actuator based on a moving rate of a valve.

Thus, it is desirable to provide a hydraulic flow control system that provides flexible control of actuator acceleration, deceleration, and response based on operational conditions. The present invention is directed to solving one or more of the problems associated with prior art designs.

SUMMARY OF THE INVENTION

In one aspect, a method is provided for controlling hydraulic flow to a hydraulic actuator. The method includes generating a command signal based on an operator input, sensing a linkage position associated with the hydraulic actuator, and selecting a moving rate of a valve associated with the hydraulic actuator based on the sensed linkage position and the command signal. The valve is modulated to control the hydraulic flow to the hydraulic actuator based on the selected moving rate.

In another aspect, a system is provided for controlling hydraulic flow to a hydraulic actuator. The system includes an operator input device configured to receive an operator input and provide a command signal based on the operator input. The system includes a sensor assembly configured to generate a signal representative of a linkage position associated with the actuator. A controller is electrically coupled to the sensor assembly and the operator input device, and the controller is configured to select a moving rate of a valve associated with the hydraulic actuator based on the sensed linkage position and the command signal and modulate the valve based on the selected moving rate.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an exemplary embodiment of the invention and together with the description, serve to explain the principles of the invention.

DETAILED DESCRIPTION

Reference will now be made in detail to an exemplary embodiment of the invention, which is illustrated in the accompanying drawings. Wherever possible, the same reference numbers will be used throughout the drawings to refer to the same or like parts.

Figure 1:
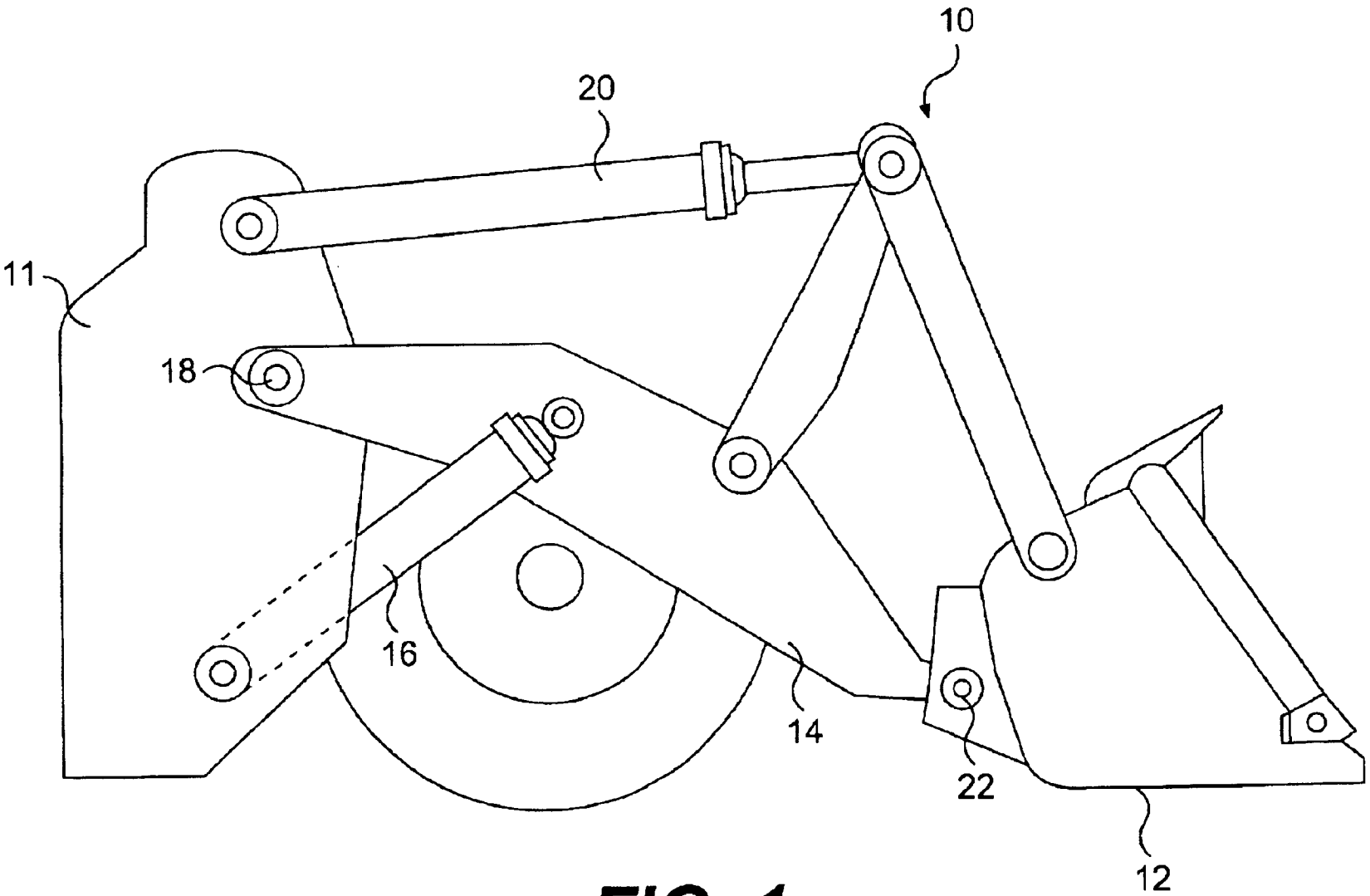
FIG. 1 is a diagrammatic side view of a forward portion of a loader.

With reference to FIG. 1, a loader 10 includes a body 11 and a bucket 12. The bucket 12 is pivotally connected to a lift arm assembly 14, which is pivotally connected to the body 11. The lift arm assembly 14 is actuated by a pair of hydraulic lift cylinders or actuators 16 (only one of them is shown in FIG. 1) about a pair of lift arm pivot pins 18 (only one of them is shown in FIG. 1). Also, the bucket 12 can be titled by a bucket tilt cylinder 20 about a tilt pivot pin 22 to scoop or dump the load in the bucket 12.

The lift cylinders 16 and bucket tilt cylinder 20 are actuated by two separate hydraulic circuits often sharing a single pump. Each hydraulic circuit includes a valve to independently control hydraulic fluid flow to the corresponding cylinder or actuator. When the operator moves a lever to lift or tilt the bucket 12, a valve associated with the hydraulic circuit for the lift cylinders 16 or the bucket tilt cylinder 20 is opened or closed to pressurize an appropriate chamber of the lift cylinders 16 or the bucket tilt cylinder 20. Lifting or tilting speed of the bucket 12 can be controlled by modulating the corresponding valve to control hydraulic fluid flow to the cylinders.

Figure 2:
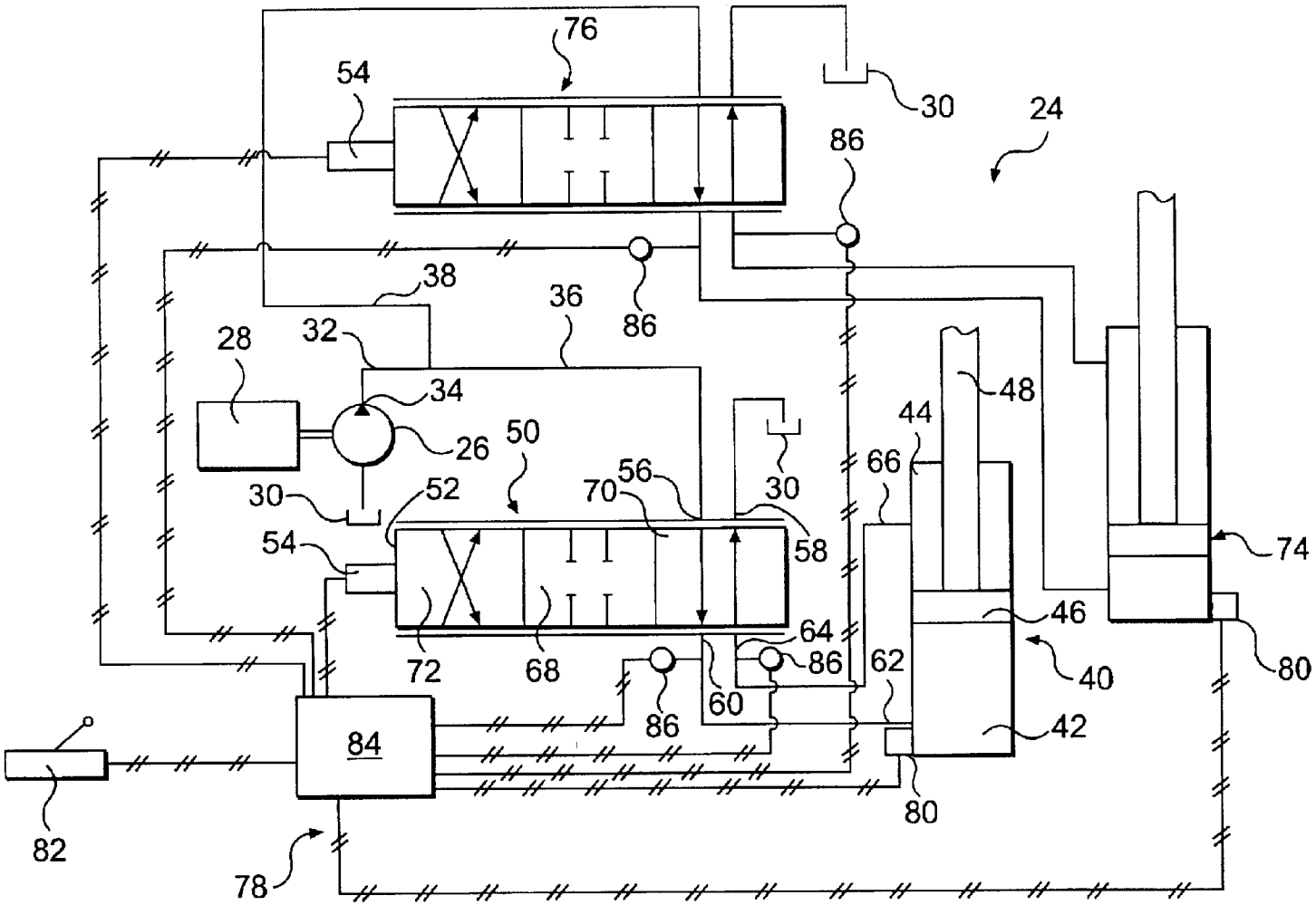
FIG. 2 is a schematic and diagrammatic representation of a hydraulic flow control system according to one exemplary embodiment of the present invention.

FIG. 2 schematically and diagrammatically illustrates a machine having hydraulic circuits and a hydraulic flow control system according to one exemplary embodiment of the invention. The machine 24 shown in FIG. 2 may be a loader, an excavator, or any other piece of equipment utilizing a hydraulic system to move a load. The machine 24 includes a pump 26 typically driven by a power source 28, such as an engine, via a drive train. The pump 26 is in fluid communication with a reservoir 30 and a main conduit 32, and provides pressurized fluid to the main conduit 32 through a pump outlet port 34.

In an exemplary embodiment shown in FIG. 2, the machine 24 includes two independently operable hydraulic circuits. The main conduit 32 is split into first and second conduits 36, 38, each conduit providing fluid to the corresponding hydraulic circuit. One hydraulic circuit may be used to raise or lower a work implement, such as the bucket 12 of the loader 10 shown in FIG. 1, while the other hydraulic circuit may be used to tilt the bucket 12. Though this exemplary embodiment is described with two hydraulic circuits, this invention is not limited to a particular number of hydraulic circuits. Some machines include multiple hydraulic circuits for a boom, a swing, a stick, an extendable stick, a bucket, and others, and the invention may be applicable to such machines.

The machine 24 also includes a hydraulic actuator 40, such as a double-acting cylinder, which receives the pressurized fluid from the first conduit 36. The hydraulic actuator 40 has a pair of actuating chambers, namely a head-end actuating chamber 42 and a rod-end actuating chamber 44. The head-end actuating chamber 42 and the rod-end actuating chamber 44 are separated by a work element or piston 46 having a piston rod 48. The hydraulic actuator 40 may be a hydraulic cylinder or any other suitable device used for extending, retracting, tilting or otherwise moving an implement of the machine 24. Though the embodiment is described with respect to a hydraulic cylinder, this invention is not limited to a cylinder, and the machine 24 may include a hydraulic motor or any other suitable hydraulic actuator.

The machine 24 also includes a valve 50 in fluid communication with the first conduit 36. The valve receives pressurized fluid from the pump 26 via the main conduit 32 and the first conduit 36. In the embodiment shown in FIG. 2, the valve 50 is a proportional directional control valve having a valve spool 52. However, the invention is not limited to directional control valves, and the valve 50 can be any other suitable valve known to those skilled in the art. By means of example only, it is contemplated that the valve 50 may be a single spool valve or an independent metering valve (IMV). As is well known to those skilled in the art, an IMV typically has a plurality of independently operable valves that may be in fluid communication with a pump, an actuator, a reservoir, and/or any other device typically present in a hydraulic circuit. The IMV allows independent metering of each of the valves to control hydraulic flow in multiple hydraulic paths.

The machine 24 also has a valve actuator 54 to move the valve spool 52 to a desired position to thereby control the hydraulic flow through the valve 50. The displacement of the valve spool 52 changes the flow rate of the hydraulic fluid through the valve 50. The flow rate of the hydraulic fluid through the valve 50 determines the moving speed of the actuator 54. By changing the displacement of the valve spool 52, the flow rate through the valve 50 is controlled. This change in the displacement of the valve 50 translates to acceleration or deceleration rates of the hydraulic actuator 54. By controlling the speed of the valve displacement change, which is a moving rate of the valve 50, acceleration and deceleration rates of the associated hydraulic actuator 54 can be controlled. The valve actuator 54 may be a solenoid actuator or any other actuator known to those skilled in the art.

In this exemplary embodiment, the valve 50 has a first port 56 connected to the pump 26 by the main conduit 32 and the first conduit 36, a second port 58 connected to the reservoir 30, a third port 60 connected to the head-end actuating chamber 42 of the hydraulic actuator 40 by a conduit 62, and a fourth port 64 connected to the rod-end actuating chamber 44 of the hydraulic actuator 40 by a conduit 66.

The valve 50 of this exemplary embodiment has a closed position 68, a first position 70, and a second position 72. In the first position 70 (shown in FIG. 2), the first port 56 and the third port 60 are in fluid communication, and the valve 50 passes the fluid from the pump 26 to the head-end actuating chamber 42 of the hydraulic actuator 40. At the same time, the second port 58 and the fourth port 64 are in fluid communication, and the valve 50 exhausts the fluid from the rod-end actuating chamber 44 to the reservoir 30. In this valve position, the hydraulic actuator 40 is extended.

Alternatively, in the second position 72, the first port 56 and the fourth port 64 are in fluid communication so that the valve 50 passes the fluid from the pump 26 to the rod-end actuating chamber 44. Simultaneously, the second port 58 is in fluid communication with the third port 60 to pass the fluid from the head-end actuating chamber 42 to the reservoir 30. In this valve position, the hydraulic cylinder 40 is retracted.

The valve spool 52 of the valve 50 can be moved by the valve actuator 54 to meter the fluid flow through the valve 50, as well as to move the valve 50 to the closed position 68, the first position 70, and the second position 72. By metering the valve 50 and controlling the valve movement, the speed, and/or acceleration/deceleration of extension or retraction of the hydraulic actuator 40 can be controlled.

As shown in FIG. 2, the machine 24 includes another hydraulic circuit having a hydraulic actuator 74 and a valve 76. In this embodiment, the hydraulic actuator 74 and the valve 76 basically have the same configuration as the hydraulic actuator 40 and the valve 50, respectively, as described above.

The machine 24 also includes a hydraulic flow control system 78, which has sensor assemblies 80 that generate a signal representative of the linkage positions associated with the actuators 40, 74. In one exemplary embodiment, the sensor assembly 80 senses the position of the piston 46 of the actuator associated with the implement, thereby effectively sensing the position of the work implement, such as a boom, a swing, a stick, an extendable stick, and a bucket with respect to the machine 24. The sensor assembly 80 is configured to generate a linkage position signal. The sensor assembly 80 may measure, either directly or indirectly, the relative extension or retraction of the actuators 40, 74. The sensor assembly 80 may have a potentiometer, a radio-frequency sensor, or any other sensor suitable for this application. One skilled in the art will appreciate that any sensor assembly capable of ascertaining the linkage position of the actuator 40, 74 may be utilized.

As shown in FIG. 2, the hydraulic flow control system 78 also includes an operator input device 82 for receiving an operator input and providing a command signal based on the operator input. The operator input device 82, such as a lever, is typically manipulated by a machine operator. The operator input device 82 receives an operator input, which is represented by a movement of the lever for operating the appropriate hydraulic actuator. The operator may move the lever in the front, back, left, right, or any other direction to operate the work implement in a desired manner. By moving the lever in a certain direction, the operator input device 82 provides a command signal. The command signal may include information as to which hydraulic circuit needs to be activated, which hydraulic actuator needs to be actuated, and in which direction the actuator needs to be moved.

The hydraulic flow control system 78 further includes a controller 84 electrically coupled to the sensor assemblies 80, the operator input device 82, and the valve actuators 54. The controller 84 receives the command signal from the operator input device 82 and the linkage position signal from the sensor assemblies 80, and sends an electrical valve command signal to the valve actuators 54. In response to the electrical command signal, the valve actuators 54 apply a varying force to controllably move the valve spool 52 to control the hydraulic flow through the valves 50, 76 to achieve a desired acceleration or deceleration rate of movement of the hydraulic actuators 40, 74, respectively. While this invention is occasionally described only in reference to a desired acceleration rate of the hydraulic actuators, it is not limited to the acceleration rate and one skilled in the art would know that the invention encompasses a deceleration rate of the hydraulic actuators.

In another embodiment, the hydraulic flow control system 78 may include a pressure sensor 86 electrically coupled to the controller 84. The pressure sensor 86 senses a circuit pressure or a load applied to the corresponding hydraulic actuator 40, 74. In one example, the pressure sensor 86 may be strain gauges or any other load determining sensors. Though the exemplary embodiment in FIG. 2 illustrates the pressure sensor 86 at the second and third ports 60, 64 of each of the valves 50, 76, the location of the pressure sensor 86 of the present invention is not limited to the specific arrangement illustrated in FIG. 2. The pressure sensor 86 can be placed at any location suitable to determine a load on the hydraulic actuators 40, 74. One skilled in the art will appreciate that any other sensor capable of ascertaining a load on a hydraulic actuator may be utilized.

In the embodiment shown in FIG. 2, the controller 84 includes a set of values of an operating parameter, such as a moving rate, for each of the valves 50, 76 to provide a desired acceleration or deceleration rate of the hydraulic actuators 40, 74 based on the inputs to the controller. These inputs may include information related to the hydraulic circuit, the linkage position, and the moving direction of the actuator. Thus, the controller 84 receives information as to, for example, which hydraulic circuit is activated, where the linkage is, and in which direction the actuator is moving, and then determines an appropriate acceleration/deceleration rate of the actuator.

In another embodiment, a load on the hydraulic actuators 40, 74 may be included as an input, and the operating parameter or moving rate may be provided for the load. The operating parameter may indicate change in hydraulic fluid flow rate through the valves 50, 76, and the valves may be modulated according to the operating parameter. In one example, the operating parameter may be an acceleration or deceleration rate of the fluid flow through the valves 50, 76 to the hydraulic actuators 40, 74. As discussed above, hydraulic flow to the hydraulic actuators 40, 74 and the resulting actuator acceleration and deceleration will vary at a given valve spool movement and position.

Each value of the operating parameter may be determined for each hydraulic circuit, linkage position, and moving direction of the actuator. In addition, the operating parameter value may be determined for the load on the actuator. Suitable values of the operating parameter may be empirically determined. The values of the operating parameter are programmed to provide a desired acceleration or deceleration rate of the hydraulic actuators 40, 74. The operating parameter values may be different based on which hydraulic circuit in the machine 24 needs to be operated. For example, if a larger hydraulic actuator is used for a hydraulic circuit to swing the machine 24 and a smaller hydraulic actuator is used for a hydraulic circuit to tilt a bucket, then the swing circuit may require a larger value of the operating parameter than the bucket tilt circuit.

In another embodiment, the values of the operating parameter or moving rate for one actuator may be determined by the linkage position and/or the moving direction of an actuator in another hydraulic circuit. For example, the hydraulic flow control system 78 may be installed in an excavator and senses a position of its bucket with respect to its body. The system 78 may be programmed to provide a slow moving rate for a swing circuit when the bucket is close to the body and a fast moving rate when the bucket is far away from the body.

Also, the location of the linkage position may be considered in determining an operating parameter. While the machine operator may wish to have a slow acceleration or deceleration rate of the work implement, i.e., a relatively slow increase or decrease in flow rate through the valve, near the end of the range of motion, the machine operator may wish to have a fast acceleration or deceleration in the middle of the range of motion. Thus, the larger value of the operating parameter may be desirable when the linkage position is in the middle of the range of motion, as opposed to when it is near the end of range of motion.

Moreover, the moving direction of the hydraulic actuators 40, 74 may be considered to achieve a desired acceleration or deceleration of the actuators. For instance, one may wish to have a slower acceleration or deceleration of the hydraulic actuator when it is extended to raise the load in the bucket and have a faster acceleration or deceleration when it is retracted to lower the empty bucket.

In another exemplary embodiment, a load on the hydraulic actuator may be considered in determining an operating parameter. If the machine 24 is used to crane a light object, the operator may wish to have a smooth and slow acceleration or deceleration rate of the hydraulic actuator with respect to the change in the lever position. On the other hand, if the machine 24 is used to dig a trench, the operator may wish to have a faster acceleration rate for the hydraulic actuator.

In one exemplary embodiment, the controller 84 may be preprogrammed with a map or table that contains operating parameter values for inputs, such as the hydraulic circuit, linkage position, direction of the actuator, and load on the actuator. Such a map or table may be created prior to the operation of the machine 24, for example, during either a test run of the hydraulic flow control system 78 or a lab test, and may be prestored in a memory located in the controller 78.

In another embodiment, the controller 84 may store mathematical equations that provide a desired operating parameter value based on the hydraulic circuit, linkage position, moving direction of the actuator, and load on the actuator. Each equation may define the operating parameter or moving rate as a function of the inputs.

INDUSTRIAL APPLICABILITY

The controller 84 of the hydraulic flow control system 78 may receive a number of inputs. Referring to FIG. 2, the sensor assemblies 80 monitor the linkage position of the hydraulic actuators 40, 74, and the linkage position signal is communicated from the sensor assemblies 80 to the controller 84. The pressure sensor 86 monitors the load on the corresponding hydraulic actuators 40, 74, and the load signal is communicated from the pressure sensor 86 to the controller 84. Also, when the machine operator manipulates the operator input device 82, the operator input device 82 provides an operator command signal to the controller. The operator command signal may include information as to which hydraulic circuit needs to be actuated and in which direction the hydraulic actuator needs to be moved.

The controller 84 includes values of the operating parameter or moving rate suitable to modulate the valves 50, 76 to achieve a desired movement, such as acceleration or deceleration rates of the implement associated with the hydraulic circuit. In one exemplary embodiment, the controller 84 includes various values of the operating parameter based on the received inputs, such as the hydraulic circuit, the linkage position, the moving direction of the actuators 40, 74, and the load on the hydraulic actuators 40, 74. In another embodiment, the controller 84 may include values of the operating parameter based on the inputs from another hydraulic circuit in the machine. These values may be stored in the form of a map (look-up table) or mathematical equations.

Based on the inputs, the controller 84 selects a value of the operating parameter from the table or equations to achieve a desired acceleration rate of the implement. Based on the selected operating parameter value, the controller 84 computes a valve command signal to one or more of the valve actuators 54 and modulates the hydraulic fluid flow through the valves 50, 76 to control acceleration and deceleration of the hydraulic actuators 40, 74, respectively.

The disclosed embodiment provides a hydraulic flow control system that provides flexible control of actuator response based on operational conditions. The described hydraulic flow control system can provide flexible control of hydraulic flow in a variety of work machines and under a variety of conditions. A loader is described in reference to this invention as an example, but the application of the invention is not limited to a loader.

It will be apparent to those skilled in the art that various modifications and variations can be made in the disclosed flow control system and method without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. A method for controlling hydraulic flow to a hydraulic actuator, the method comprising:

generating a command signal based on an operator input;

sensing a linkage position associated with the hydraulic actuator;

selecting a moving rate from a prestored set of moving rates of a valve associated with the hydraulic actuator based on the sensed linkage position and the command signal; and modulating the valve to control the hydraulic flow to the hydraulic actuator based on the selected moving rate.

2. The method of claim 1, wherein the moving rate of the valve relates to one of an acceleration rate and a deceleration rate of the hydraulic actuator.

3. The method of claim 1, wherein the command signal is indicative of the hydraulic actuator to be moved and a desired direction of the movement of the hydraulic actuator.

4. The method of claim 1, wherein the linkage position is sensed by sensing a position of a work implement.

5. The method of claim 1, further including sensing a load applied to the hydraulic actuator, and wherein the moving rate of the valve is selected based on the sensed linkage position, the command signal, and the sensed load.

6. The method of claim 1, wherein the operator input is represented by a movement of a lever.

7. A method for controlling hydraulic flow, comprising:

providing a plurality of hydraulic circuits, each of the hydraulic circuits having at least one hydraulic actuator and one valve associated with the hydraulic actuator;

generating a command signal based on an operator input;

selecting which of the hydraulic actuators is to be actuated based on the command signal;

sensing a linkage position associated with the selected hydraulic actuator;

selecting a moving rate from a prestored set of moving rates of the valve associated with the hydraulic actuator based on the sensed linkage position and the command signal; and modulating the valve to control the hydraulic flow to the hydraulic actuator based on the selected moving rate.

8. The method of claim 7, further including sensing a load applied to the selected hydraulic actuator, and wherein the moving rate of the valve is selected based on the sensed linkage position, the command signal, and the sensed load.

9. The method of claim 7, wherein the moving rate of the valve in a first hydraulic circuit is selected based on a linkage position associated with a valve in a second hydraulic circuit.

10. A system for controlling hydraulic flow to a hydraulic actuator, the system comprising:

an operator input device configured to receive an operator input and provide a command signal based on the operator input;

a sensor assembly configured to generate a signal representative of a linkage position associated with the actuator; and a controller electrically coupled to the sensor assembly and the operator input device, the controller being configured to select a moving rate from a prestored set of moving rates of a valve associated with the hydraulic actuator based on the sensed linkage position and the command signal and modulate the valve based on the selected moving rate.

11. The system of claim 10, wherein the moving rate of the valve relates to one of an acceleration rate or a deceleration rate of the hydraulic actuator.

12. The system of claim 10, wherein the operator input device is an operator lever.

13. The system of claim 10, wherein the command signal is indicative of the hydraulic actuator to be moved and a desired direction of the movement of the hydraulic actuator.

14. The system of claim 13, wherein the hydraulic circuit is one of hydraulic circuits associated with a boom, a swing, a stick, an extendable stick, and a bucket.

15. The system of claim 10, further including a pressure sensor electrically coupled to the controller, the pressure sensor being configured to sense a load applied to the hydraulic actuator.

16. The system of claim 15, wherein the controller is configured to select the moving rate of the valve based on the sensed linkage position, the command signal, and the sensed load.

17. A machine for moving a load, comprising:

a pump;

a hydraulic actuator in fluid communication with the pump;

a valve in fluid communication with the pump and the hydraulic actuator;

an operator input device configured to receive an operator input and provide a command signal based on the operator input;

a sensor assembly configured to generate a signal representative of a linkage position associated with the actuator; and a controller electrically coupled to the sensor assembly and the operator input device, the controller being configured to select a moving rate from a prestored set of moving rates of the valve based on the sensed linkage position and the command signal and modulate the valve based on the selected moving rate.

18. The machine of claim 17, wherein the moving rate of the valve is one of an acceleration rate and a deceleration rate.

19. The machine of claim 17, wherein the command signal is indicative of the hydraulic actuator to be moved and a desired direction of the movement of the hydraulic actuator.

20. The machine of claim 17, further including a pressure sensor electrically coupled to the controller, the pressure sensor being configured to sense a load applied to the hydraulic actuator, and wherein the controller is configured to select the moving rate of the valve based on the sensed linkage position, the command signal, and the sensed load.

* * * * *